US010004331B2

(12) United States Patent
Jeffries et al.

(10) Patent No.: US 10,004,331 B2
(45) Date of Patent: Jun. 26, 2018

(54) DRAWER RELEASE

(75) Inventors: Mark Steven Jeffries, Buford, GA (US); Norman Allen Smith, Buford, GA (US)

(73) Assignee: Austin Hardware & Supply Inc., Lee's Summit, MO (US)

( * ) Notice: Subject to any disclaimer, the term of this patent is extended or adjusted under 35 U.S.C. 154(b) by 359 days.

(21) Appl. No.: 13/052,631

(22) Filed: Mar. 21, 2011

(65) Prior Publication Data

US 2011/0169389 A1 Jul. 14, 2011

Related U.S. Application Data

(60) Provisional application No. 61/315,689, filed on Mar. 19, 2010.

(51) Int. Cl.

| | |
|---|---|
| ***A47B 95/02*** | (2006.01) |
| ***B21C 23/14*** | (2006.01) |
| ***E05B 65/46*** | (2017.01) |

(52) U.S. Cl.

CPC ..... *A47B 95/02* (2013.01); *B21C 23/142* (2013.01); *E05B 65/46* (2013.01); *Y10T 29/49826* (2015.01); *Y10T 292/57* (2015.04)

(58) Field of Classification Search

CPC ..... A47B 95/02; B21C 23/142; E05B 65/46; Y10T 29/49826; Y10T 292/57

USPC ..... 312/330.1, 332.1, 333; 72/253.1; 292/336.3

See application file for complete search history.

(56) References Cited

U.S. PATENT DOCUMENTS

| | | | | |
|---|---|---|---|---|
| 1,845,335 | A * | 2/1932 | Rosendahl | E05B 65/46 292/226 |
| 3,389,854 | A * | 6/1968 | Coopersmith | A47G 29/126 16/374 |
| 3,782,800 | A * | 1/1974 | Remington et al. | 312/333 |
| 3,953,094 | A * | 4/1976 | Brown, Jr. | G11B 17/032 292/336.3 |
| 4,003,614 | A * | 1/1977 | Geer | E05B 65/46 292/240 |
| 4,040,695 | A * | 8/1977 | Brann | A47B 95/02 16/416 |
| 4,947,661 | A * | 8/1990 | Yoshida | B60K 37/04 248/27.1 |
| 5,292,191 | A * | 3/1994 | Slivon | 312/332.1 |
| 6,375,235 | B1 * | 4/2002 | Mehmen | 292/128 |
| 6,431,615 | B1 * | 8/2002 | Bastian | 292/80 |
| 6,527,353 | B1 * | 3/2003 | Bradfish et al. | 312/332.1 |
| 6,547,289 | B1 | 4/2003 | Greenheck et al. | |
| 6,851,286 | B2 | 2/2005 | Dube et al. | |

(Continued)

FOREIGN PATENT DOCUMENTS

| | | | | |
|---|---|---|---|---|
| DE | 3326400 A1 * | 1/1985 | | E05B 65/46 |
| GB | 1188190 A * | 4/1970 | | A47B 88/49 |

(Continued)

*Primary Examiner* — Andrew M Roersma

(74) *Attorney, Agent, or Firm* — Polsinelli PC

(57) ABSTRACT

A drawer release is described. The drawer release includes a handle portion pivotally or rotatably engaged to a fixed portion, and the fixed portion is attached to or connected to a drawer. The handle portion includes at least one engaging member that engages a lever or actuator of a drawer-slide of the drawer to open or release the drawer. The drawer release provides for the one-handed opening of the drawer.

36 Claims, 14 Drawing Sheets

(56) References Cited

U.S. PATENT DOCUMENTS

| | | | | |
|---|---|---|---|---|
| 6,932,694 | B2 * | 8/2005 | Jeffries | 454/145 |
| 7,048,347 | B1 * | 5/2006 | Liu | 312/332.1 |
| 7,552,950 | B2 * | 6/2009 | Scheffy et al. | 292/95 |
| 8,491,068 | B2 * | 7/2013 | Weng et al. | 312/332.1 |
| 9,010,830 | B2 * | 4/2015 | Hanley | B60R 7/08 296/24.44 |
| 2004/0020248 | A1 * | 2/2004 | Dube | E05B 65/46 70/85 |
| 2004/0056572 | A1 * | 3/2004 | Chen et al. | 312/333 |
| 2005/0150082 | A1 * | 7/2005 | Shih | E05B 65/46 16/422 |
| 2005/0218760 | A1 * | 10/2005 | Cheng | E05B 65/46 312/333 |
| 2006/0103278 | A1 * | 5/2006 | Bousquet | 312/332.1 |
| 2007/0257588 | A1 * | 11/2007 | Chen et al. | 312/333 |
| 2008/0150407 | A1 * | 6/2008 | Mehmen | 312/332.1 |
| 2009/0102333 | A1 * | 4/2009 | Weng | 312/222 |
| 2009/0205357 | A1 * | 8/2009 | Lim et al. | 62/441 |
| 2009/0301146 | A1 * | 12/2009 | Jeffries | 70/162 |
| 2010/0019636 | A1 * | 1/2010 | Chen et al. | 312/332.1 |
| 2010/0101267 | A1 * | 4/2010 | Jung et al. | 62/449 |
| 2011/0121701 | A1 * | 5/2011 | Chang | 312/332.1 |
| 2011/0309730 | A1 * | 12/2011 | Retchloff et al. | 312/332.1 |

FOREIGN PATENT DOCUMENTS

| | | | | |
|---|---|---|---|---|
| JP | H074128 | A * | 1/1995 | E05B 65/46 |
| JP | WO2009050981 | A1 * | 4/2009 | E05B 65/44 |

* cited by examiner

DRAWER RELEASE

CROSS REFERENCE TO RELATED APPLICATION

This application claims the benefit of U.S. Provisional Patent Application No. 61/315,689 filed Mar. 19, 2010, which is hereby incorporated by reference.

FIELD OF INVENTION

The present invention relates to a drawer release for opening a drawer.

BACKGROUND OF INVENTION

Conventional drawers on cargo and utility trucks are mounted to drawer-slides that allow the drawers to slide in and out. The drawer-slides typically having a bearing arrangement to allow the drawer to slide easily in and out. The drawer-slides are mounted to the drawer and a support structure or housing, such as a cabinet.

Some of the drawer-slides include locking mechanisms on one or both sides of the drawer. These locking mechanisms may lock the drawer in an open or closed position or both the open and closed positions. Such locking mechanisms are especially useful when the truck is parked on an incline to prevent the accidental opening of the drawer.

In order to unlock the drawer, the operator must manually actuate the locking mechanism on both sides of the drawer, which is difficult or impossible to do with a single hand. As such, in order to use both hands to unlock the drawer, the operator may have to inconveniently set down their cargo or item intended for the storage area within the drawer before the drawer can be conveniently opened.

SUMMARY OF THE INVENTION

A drawer release is herein described. The drawer release is affixed, attached, or otherwise integral with a drawer of a cabinet or a housing. The drawer release may be positioned on the front face or front portion of the drawer. The drawer release provides for the one-handed unlocking and opening of the drawer. The drawer release unlocks or unlatches a locking mechanism or a latch of a drawer-slide that is holding the drawer in a slideable engagement with respect to the cabinet or the housing.

The drawer release includes a handle or a handle extrusion that extends generally the entire width of the drawer. The drawer release unlocks one or both latches or locks on one or both drawer-slides that provide for the sliding engagement of the drawer to the cabinet or the housing. The drawer release allows an operator to pull on the handle or the handle extrusion at any point along the handle or the handle extrusion to unlock the drawer. The drawer release provides for the rotating motion from pulling the handle or the handle extrusion to be translated to a generally downward movement on pins or lever-engaging members that unlocks or releases the drawer to be opened.

The drawer release may be used with conventional lockin-lockout drawer-slides that include one or more locks or latches on one or both sides of the drawer. These lockin-lockout drawer-slides use a lever or trigger on both sides of the drawer that unlocks the drawer-slide to allow the drawer-slide to slide to an open position. The drawer release may also be used with drawer-slides having a lock or latch on only one side of the drawer. The drawer release may also be used with drawer-slides that do not lock in or lock out.

The drawer release actuates the levers on both sides of the drawer. Importantly, the drawer release allows an operator to open big and heavy drawers with one hand. As such, a one-handed pulling motion by an operator on any portion of the handle may depress the levers positioned on opposite sides of the drawer. This allows the operator to hold something in one hand and open the drawer with their opposite hand.

The drawer release may be used on a variety of different drawers, ranging in depth from approximately two inches to approximately ten inches and ranging in width from approximately 6 inches to several feet or more. The drawer release may be used on a single drawer or on each drawer in a stack of drawers, such as in a cabinet.

The handle portion or the handle extrusion is hingedly or pivotally engaged to the fixed portion or the fixed extrusion. The fixed extrusion and the handle extrusion may be manufactured by extruding molten aluminum through a die or other pattern. The handle portion and the fixed portion may also be formed by roll forming or stamping. The fixed extrusion and the handle extrusion may also be manufactured by extruding plastics.

Large lengths of the fixed extrusion and the handle extrusion may be formed and then cut to a length of the drawer. For example, an 8 foot length of the fixed extrusion or the handle extrusion may be formed and then cut into 12 inch, 15 inch, 24 inch or other common sizes to fit stock drawers. The specific length of the fixed extrusion and the handle extrusion may also be cut to custom sizes.

Opposite sides of the handle portion or extrusion include spring-actuated pins or engaging members that are moved by the handle portion or the handle extrusion. As the handle portion or handle extrusion is pulled, the pins or engaging members contact the levers or triggers of the drawer-slides. The pins or engaging members may be used to press on, actuate, or to depress levers, triggers, or actuators of the drawer-slides.

In further aspects, the pins may engage a striker that is fixed to the frame or the jamb of the cabinet. The engagement of the pin to the striker allows for the drawer to be closed securely. The drawer may also be slammed or pushed shut, which engages the pin to the striker for a locking closure.

In further aspects, a drawer release is provided. The drawer release includes a handle portion pivotally engaged to a fixed portion, and the fixed portion is attached to or connected to a drawer. The handle portion and the fixed portion extend an entire or substantially the entire width of the drawer. The handle portion includes at least one engaging member that engages a lever or actuator of a drawer-slide of the drawer to open or release the drawer.

In further aspects, a drawer release is provided. The drawer release includes a handle extrusion and a fixed extrusion that is connected or attached to a drawer. The handle extrusion pivots relative to the fixed extrusion. The handle extrusion includes one or more pins to engage at least one striker mounted to or integral with sides or a frame of a cabinet holding the drawer. The engagement of the pin to the striker maintains the drawer in a closed position relative to the cabinet or the frame.

In further aspects, a drawer release is provided. The drawer release includes a handle extrusion comprising a curved channel. The drawer release includes a fixed extrusion comprising a curved portion. The curved channel of the handle extrusion pivots about the curved portion of the fixed extrusion. The handle extrusion includes a first pin and a second pin. The first pin engages a first lever of a first drawer-slide, and the second pin engages a second lever of a second drawer-slide.

In further aspects, a method of opening a drawer is provided. The method includes providing a drawer release having a handle portion pivotally engaged to a fixed portion. The handle portion includes at least one lever engaging member that engages a lever of a drawer-slide. The method further includes pulling on the handle portion to pivot the handle portion relative to the fixed portion. The method includes causing the at least one lever engaging member to engage the lever of the drawer-slide. The method includes releasing a latch or a lock on the drawer-slide to unlatch or unlock the drawer-slide.

In further aspects, a method of opening a drawer is provided. The method includes providing a drawer release having a handle portion pivotally engaged to a fixed portion, and the drawer release is attached or integral with a drawer. The handle portion includes at least one striker engaging member that engages a striker affixed or integral to a cabinet or a frame comprising the drawer. The method includes pulling on the handle portion to pivot the handle portion relative to the fixed portion. The method includes causing the at least one striker engaging member to disengage from the at least one striker. The method includes opening the drawer.

In further aspects, a method of manufacturing a drawer is provided. The method includes providing a drawer with a drawer-slide. The method includes providing a drawer release, the drawer having a handle portion pivotally engaged to a fixed portion, and the handle having at least one lever engaging member that engages a lever of the drawer-slide. The method includes attaching the drawer release to a front wall of a drawer. The method includes positioning the lever engaging member to engage the lever of the drawer-slide.

The drawer release includes a handle or a handle extrusion that may be used with push-pull drawer-slides. Push-pull drawer-slides may lock in both the open and in the closed positions. Push-pull drawer-slides typically require the operator to pull an end of the drawer-slide outward in order to unlock or unlatch the drawer-slide, and then the drawer may be fully opened. Further, the push-pull drawer-slides typically require the operator to push the end of the drawer-slide inward in order to unlock or unlatch the drawer-slide, and then the drawer may be pushed closed.

The drawer release unlocks one or both latches or locks on one or both push-pull drawer-slides that provide for the sliding engagement of the drawer to the cabinet or the housing. The drawer release allows an operator to pull or push on the handle or the handle extrusion at any point along the handle or the handle extrusion to unlock the drawer. The drawer release provides for the rotating motion from pulling the handle or the handle extrusion to be translated to a generally horizontal, lateral, or arcuate movement that pushes or pulls on the ends of the push-pull drawer-slides that unlocks or releases the drawer to be opened or closed.

The handle or handle extrusion generally extends the entire width of the drawer. The handle or handle extrusion includes a pin or other engaging member that contacts the ends of the drawer-slide in order to translate the pushing or pulling movement on the handle or handle extrusion to the ends of the drawer-slide. The end of the drawer-slide may be fitted or configured with a drawer-slide end cap, which receives or holds the pin or other engaging member of the handle or the handle extrusion. The drawer release may actuate the ends on both push-pull drawer-slides of the drawer. Importantly, the drawer release allows an operator to open big and heavy drawers with one hand. As such, a one-handed pulling or pushing motion by an operator on any portion of the handle or the handle extrusion may push or pull the ends of the drawer-slides positioned on opposite sides of the drawer. This allows the operator to hold something in one hand and open or close the drawer with their opposite hand.

In further aspects, a method of opening a drawer is provided. The method includes providing a drawer release having a handle portion pivotally engaged to a fixed portion. The handle portion includes an engaging member or pin that engages or contacts ends of a drawer-slide to push or pull the ends of the drawer-slide. The method further includes pulling or pushing on the handle portion to pivot the handle portion relative to the fixed portion. The method includes causing the engaging member or pin to push or pull on the ends of the drawer-slide. The method includes releasing a latch or a lock of the drawer-slide to unlatch or unlock the drawer-slide.

In further aspects, a method of manufacturing a drawer is provided. The method includes providing a drawer with a push-pull drawer-slide. The method includes providing a drawer release, the drawer release having a handle portion pivotally engaged to a fixed portion. The handle portion includes an engaging member or pin that engages or contacts an end of the drawer-slide to push or pull the end of the drawer-slide. The method includes attaching the drawer release to a front wall of a drawer. The method includes positioning the engaging member or pin to engage the end of the drawer-slide.

In further aspects, a method of manufacturing a drawer is provided. The method includes providing a drawer with a push-pull drawer-slide. The method includes providing a drawer release, the drawer release having a handle portion pivotally engaged to a fixed portion. The handle portion includes an engaging member or pin that engages or contacts an end of the drawer-slide to push or pull the end of the drawer-slide. The method includes attaching the drawer release to a front wall of a drawer. The method includes fitting or a connecting a drawer-slide end cap to the push-pull drawer-slide. The method includes positioning the engaging member or pin to the drawer-slide end cap.

DETAILED DESCRIPTION

A drawer release is described. The drawer release includes a handle portion or a handle extrusion pivotally engaged to a fixed portion or a fixed extrusion. The fixed portion or the fixed extrusion is attached, connected to, or integral with a drawer. The handle portion or the handle extrusion includes at least one engaging member that engages a lever, actuator, or trigger of a drawer-slide of the drawer to open or release the drawer. The drawer release provides for the one-handed opening of the drawer. The drawer release provides for the one-handed opening of the drawer by unlocking drawer-slides on opposite sides of the drawer.

The drawer release is used with drawers that are engaged to the drawer-slides. The drawer release unlocks or unlatches the drawer-slides such that a drawer may be opened, closed, or otherwise moved via the drawer-slides. The drawer release is positioned on a front surface of the drawer. The drawer release extends most of or all of the width of the drawer. The drawer release actuates the drawer-slides to unlock or unlatch the drawer-slides.

Figure 1:
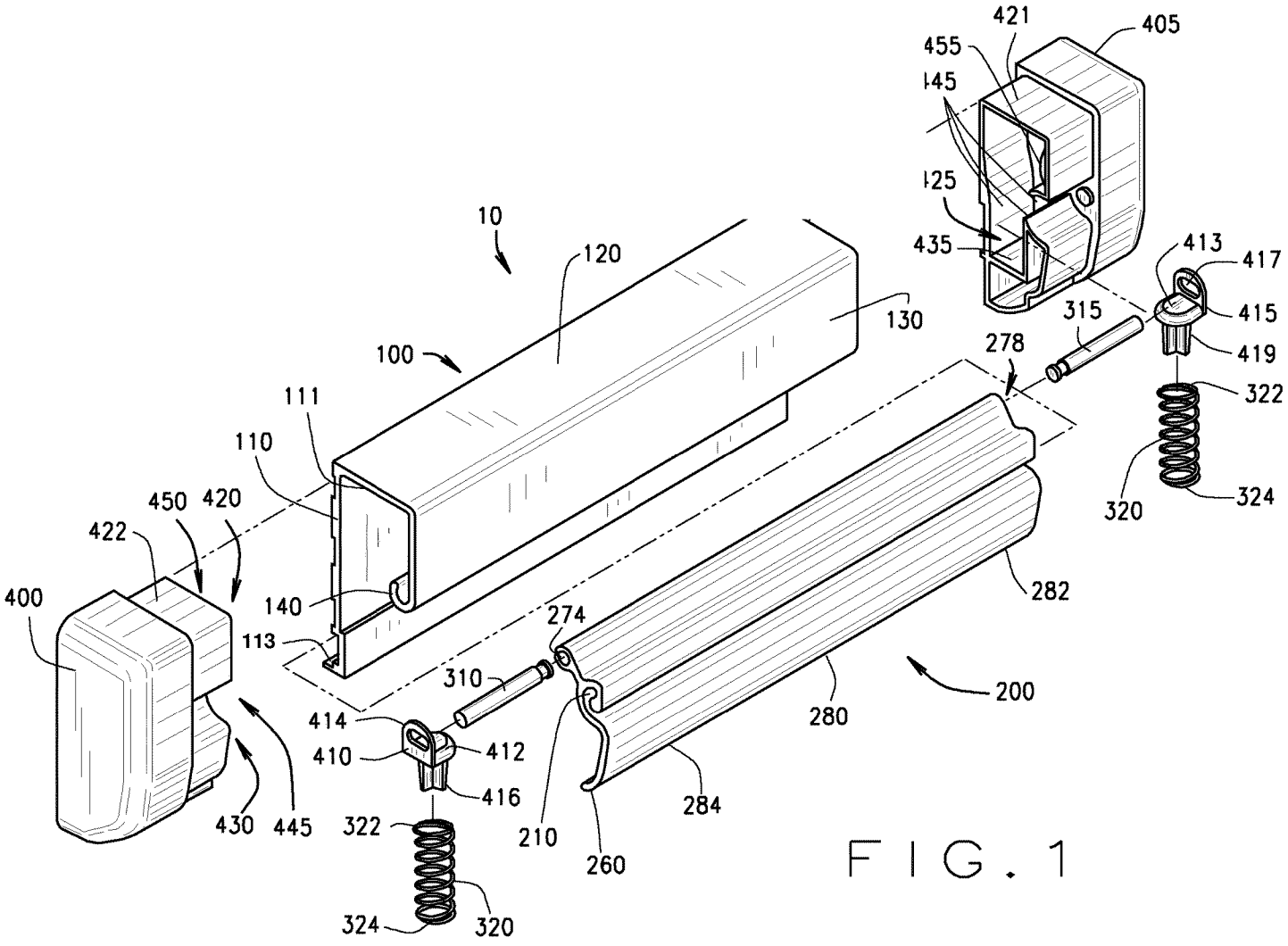
FIG. 1 is an exploded view of the drawer release.
Figure 5:
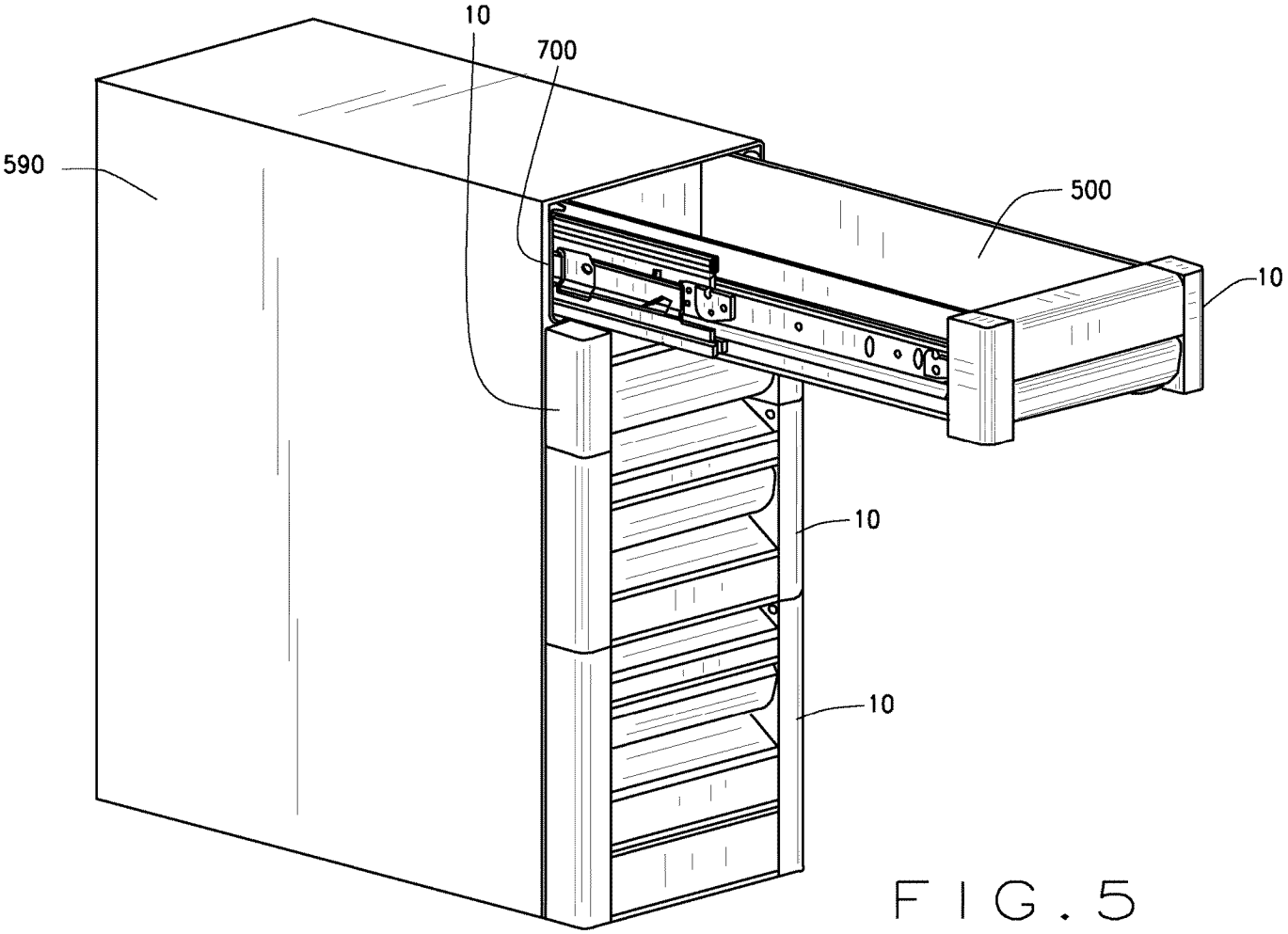
FIG. 5 is a view of one drawer with the drawer release opening from the cabinet containing multiple drawers with drawer releases.

The drawer release will now be described with reference to the FIGS. FIG. 1 shows an exploded view of a drawer release 10. The drawer release 10 includes a fixed extrusion 100 hingedly engaged to a handle extrusion 200. The handle extrusion 200 is pulled to unlock a drawer 500 (shown in FIG. 5). The fixed extrusion 100 remains in a generally fixed or stationary position relative to the drawer 500, while the handle extrusion 200 pivots or rotates relative to the fixed extrusion 100. The fixed extrusion 100 may include openings to receive screws, rivets, and the like in order to attach the fixed extrusion 100 to the drawer 500.

With continued reference to FIG. 1, the fixed extrusion 100 includes a rear wall 110 that transitions into a top wall 120. The top wall 120 transitions into a front wall 130 that includes a curved portion 140. The rear wall 110 and the front wall 130 are generally arranged in a parallel alignment separated by the length or depth of the top wall 120. The fixed extrusion 100 defines an interior that provides space for the pivoting or rotating movement of the handle extrusion 200.

A bottom portion of the rear wall 110 may include an alignment lip 113 that is used to assist in alignment of the fixed extrusion 100 to the drawer 500. The alignment lip 113 may also be positioned at top portion of the rear wall 110. The alignment lip 113 helps to square the fixed extrusion 100 to the drawer 500.

Figure 2C:
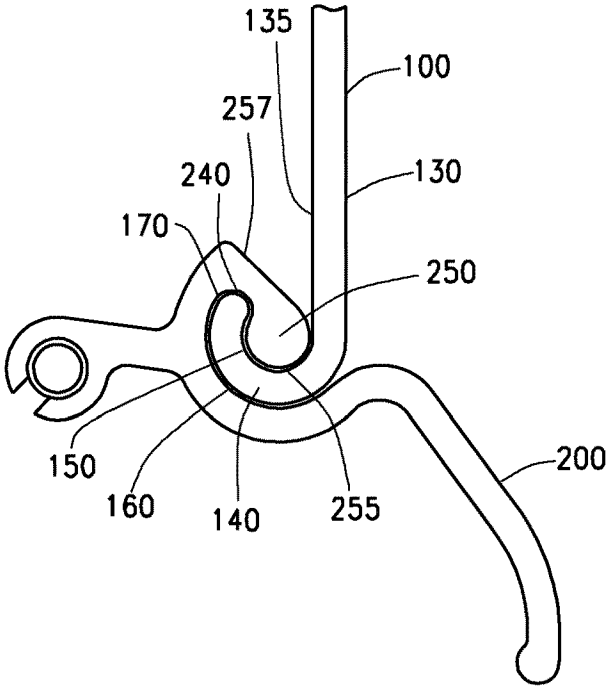
FIGS. 2(A)-2(C) are close-up views of the hinging connection.
Figure 2B:
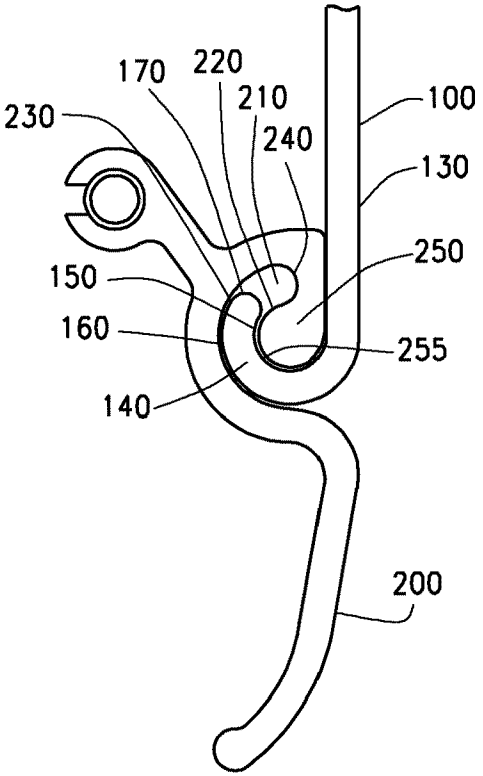
Figure 2A:
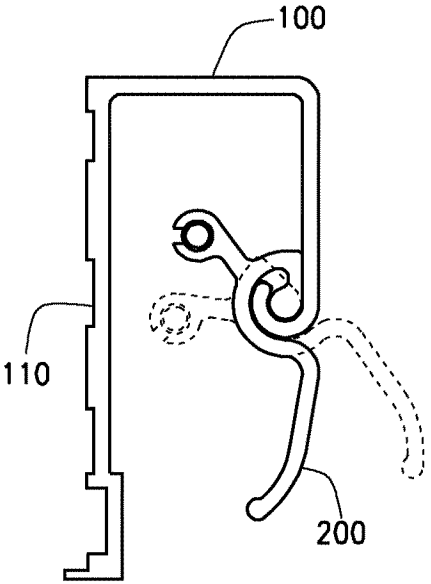
Figure 3A:
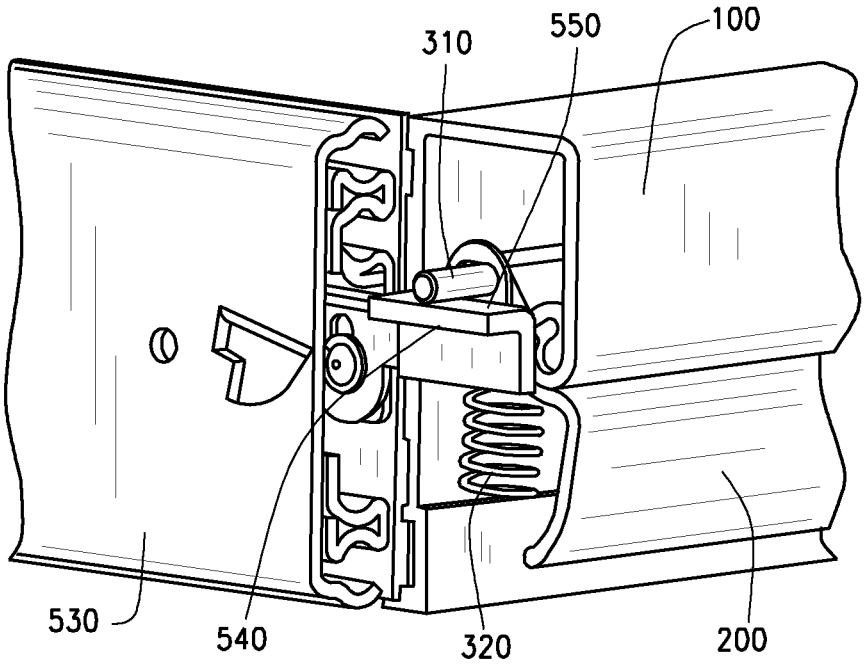
FIGS. 3(A)-3(D) are views of the engaging member contacting the lever.
Figure 3B:
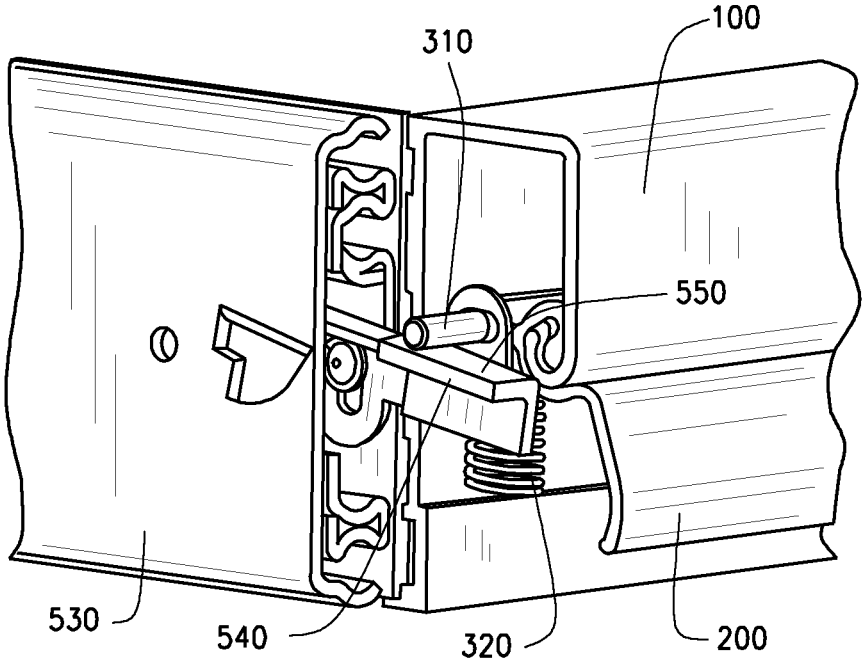
Figure 3C:
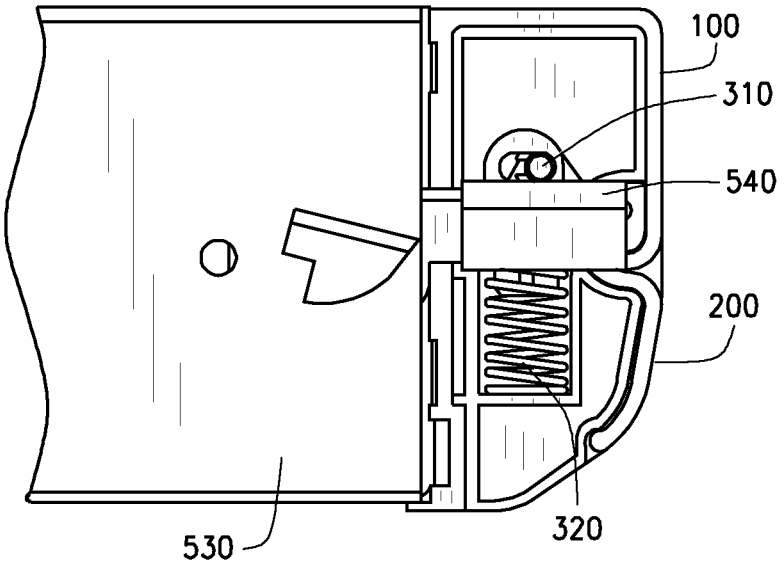
Figure 3D:
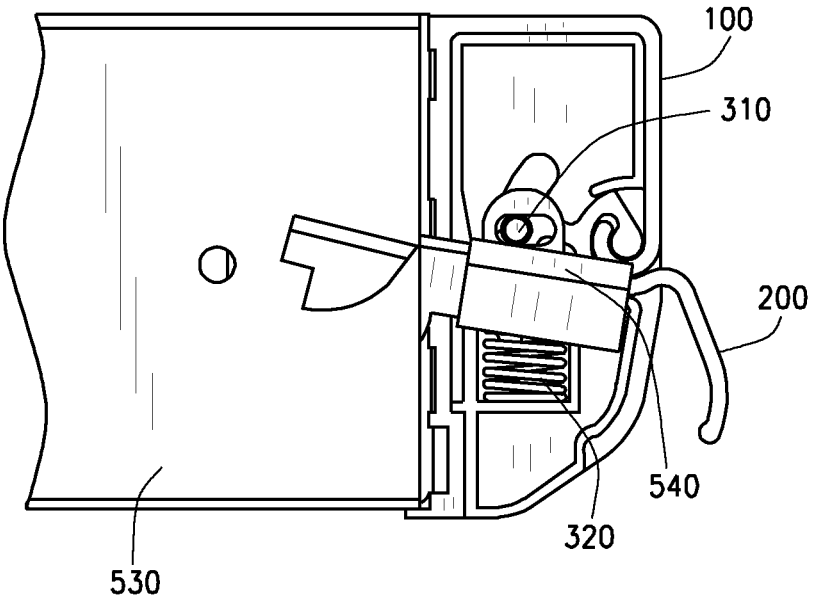
Figure 4C:
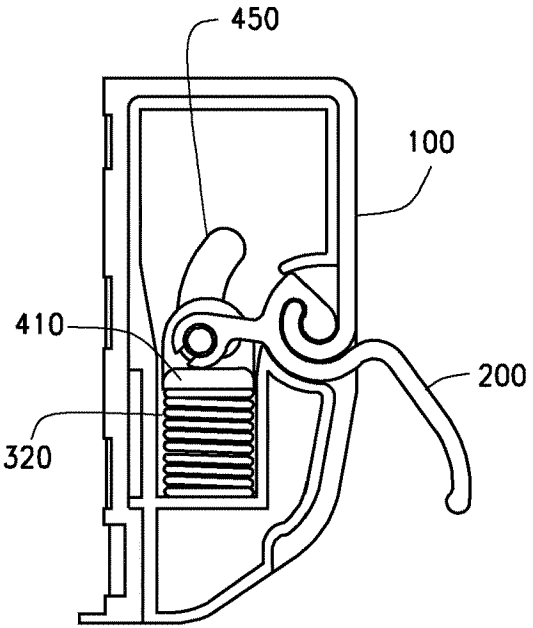
FIGS. 4(A)-4(C) shows views of the handle during opening and closing.
Figure 4B:
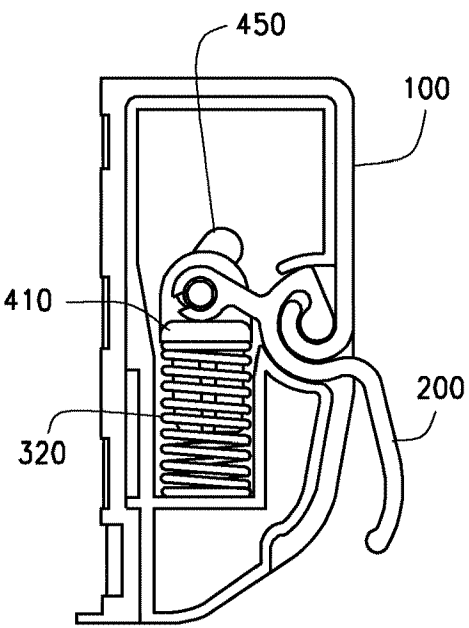
Figure 4A:
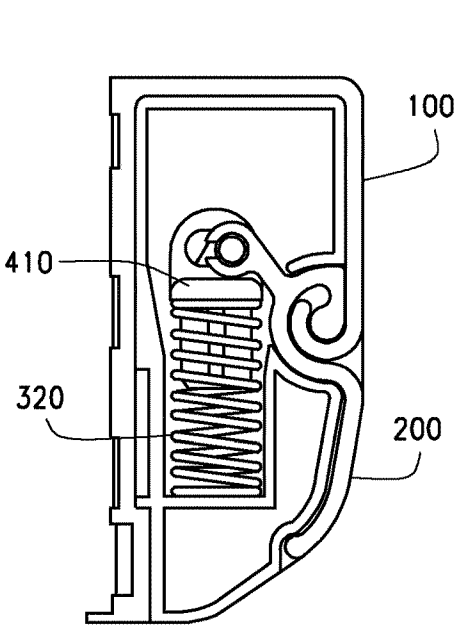

With reference to FIGS. 2(A) and 2(B), the curved portion 140 includes an inner curved surface 150 and an outer curved surface 160. The curved portion 140 terminates in an end 170. The curved portion 140 forms a portion of the hinge or the hingeable connection between the fixed extrusion 100 and the handle extrusion 200. The curved portion 140 extends most of or all of the width of the drawer 500. The handle extrusion 200 includes a curved channel 210 that includes a curved channel inner surface 220 and a curved channel outer surface 230. The curved channel inner surface 220 and the curved channel outer surface 230 of the handle extrusion 200 are slideably engaged to the curved portion 140 of the fixed extrusion 100. The curved channel 210 extends most of or all of the width of the drawer 500.

The handle extrusion 200 includes an axis 250 that provides an axis of rotation for the handle extrusion 200. An axis surface 255 of the axis 250 rotates against the inner curved surface 150 of the fixed extrusion 100.

The curved channel 210 terminates in an end wall 240. The handle extrusion 200 rotates until the end wall 240 contacts the end 170 of the fixed extrusion 100. Further, an outer wall 257 of the handle extrusion 200 contacts an inner surface 135 of the fixed extrusion 100 when the handle extrusion 200 is in the fully closed position.

The handle extrusion 200 includes a gripping surface 260 that is positioned on or in the handle extrusion 200. The gripping surface 260 may extend an entire width of the handle extrusion 200 between a left portion 284 of the handle extrusion 200 and a right portion 282 of the handle extrusion 200. In other aspects, the grip 260 may just be located at the middle portion 280 of the handle extrusion 200.

The handle extrusion 200 includes or defines a first opening 274 and a second opening 278. The first opening 274 and the second opening 278 receive or include a first pin 310 and a second pin 315, respectively. The first opening 274 and the second opening 278 are positioned on opposite sides of the handle extrusion 200 to position the first pin 310 and the second pin 315 adjacent to the locking mechanisms of the drawer-slides. With reference to FIGS. 3(A)-3(D), during actuation of the drawer release 10, the first pin 310 and the second pin 315 engage a lever 540 of a left drawer-slide 530 and a lever 545 of a right drawer-slide 535, respectively. In other aspects, the drawer release 10 may only contain a single pin, such as the first pin 310, on one side of the drawer release 10. Some drawers may only have a locking drawer-slide on one side of the drawer, with a non-locking drawer-slide on the other side of the drawer. As such, the second pin 315 may be omitted from the drawer-release 10.

A left end cap 400 is fixedly engaged to a left portion 111 of the fixed extrusion 100, while a right end cap 405 is fixedly engaged to a right portion 112 of the fixed extrusion 100. The left end cap 400 and the right end cap 405 include a spring biasing member to bias the handle extrusion 200 in a closed position. The end caps 400, 405 may be made from metal or plastic.

With reference to FIG. 1, the left end cap 400 includes a spring guide 410, and the right end cap 405 includes a spring guide 415. The spring guides 410, 415 include a spring guide base 412, 413. The spring guide bases 412, 413 are engaged to a first end 322 of the spring 320. As such, the spring 320 pushes the spring guides 410, 415 in an upward direction. A spring guide opening 414 receives the first pin 310, while a spring guide opening 417 receives the second pin 315. Spring guide inserts 416 and 419 are positioned into the first ends 322 of the springs 320.

The left end cap 400 and the right end cap 405 have substantially the same construction, except with an opposite orientation to each other. The left end cap 400 and the right end cap 405 includes spring retainer 420 and 425, respectively.

The spring retainers 420, 425 form a housing to hold the biasing members. The spring retainers 420, 425 include base surfaces 430, 435 and several sidewalls 440, 445. The base surfaces 430, 435 receive a second end 324 of the spring 320. The spring 320 thus biases against the base surfaces 430, 435 of the spring retainers 420, 425. The sidewalls 440 and 445 maintain a substantially vertical orientation to the movement of the spring 320 and the spring guides 410, 415.

The left end cap 400 and the right end cap 405 further define or include pin guides 450, 455, which provide an opening in the left end cap 400 and the right end cap 405. The first pin 310 and the second pin 315 extend through the pin guides 450, 455 to depress the levers 540, 545.

The left end cap 400 and the right end cap 405 define or include insert portions 422, 421 that fixedly engage to the left portion 111 of the fixed extrusion 100 and the right portion 112 of the fixed extrusion 100, respectively.

As the handle extrusion 200 is pulled by the operator, the axis 250 rotates within the curved portion 140. The curved channel inner surface 220 and curved channel outer surface 230 of the handle extrusion 200 slide against the inner curved surface 150 and the outer curved surface 160 of the curved portion 140 of the fixed extrusion 100. In this embodiment, the curved portion 140 has a hook-shape or j-shape.

The handle extrusion 200 may continue to be pulled outward and/or upward until the end wall 240 of the handle extrusion 200 contacts the end 170 of the fixed extrusion 100. When the handle extrusion 200 is pulled outward, the pins 310, 315 are moving generally downward and overcoming the bias of the spring 320. The pins 310, 315 are positioned on an opposite side of the axis 250 as the gripping surface 260 of the handle extrusion 200. The axis 250 acts as a fulcrum point separating the pins 310, 315 from the gripping surface 260.

As the pins 310 and 315 move downward, they contact the lever surfaces 550 and 555 of the levers 540 and 545. The contact between the first pin 310 and the second pin 315 presses on the lever 540 and 545 to release or unlock a left drawer latch 560 and a right drawer latch 570 to allow the drawer-slides 530 and 535 to be unlocked and opened. As such, pulling the handle extrusion 200 simultaneously unlocks both of the drawer-slides 530 and 535.

Figure 6:
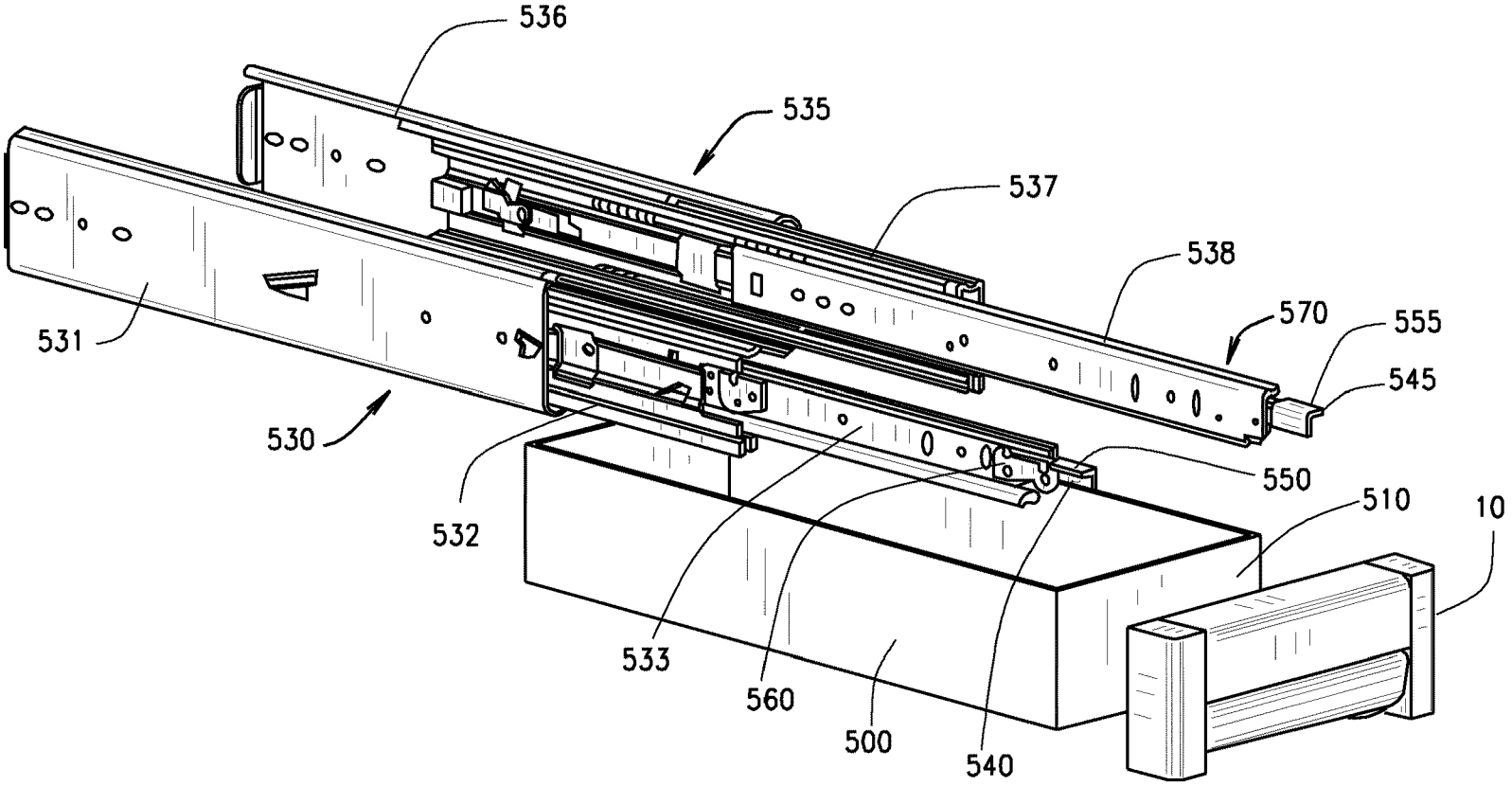
FIG. 6 is an exploded view of the drawer and drawer release.
Figure 7A:
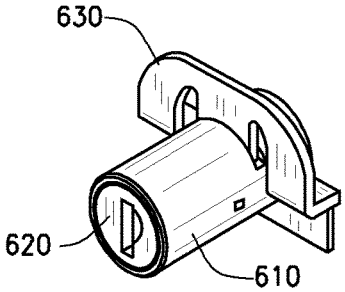
FIGS. 7(A)-7(F) shows the locking assembly.
Figure 7B:
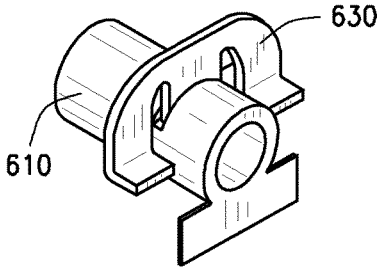
Figure 7C:
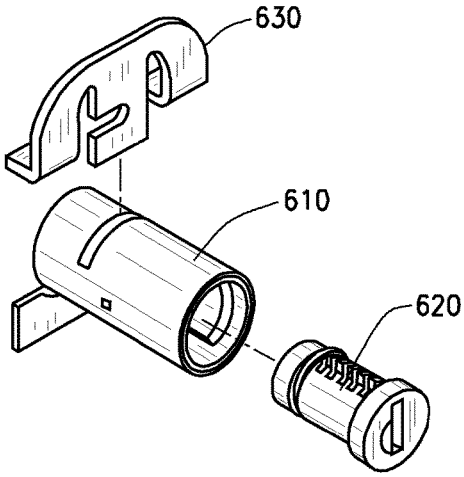
Figure 7D:
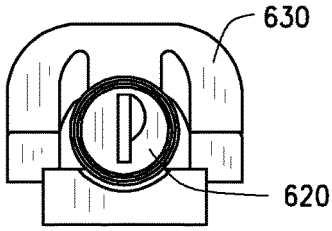
Figure 7E:
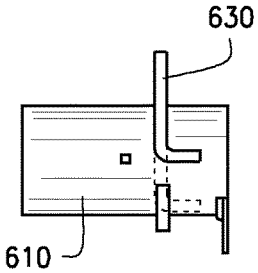
Figure 7F:
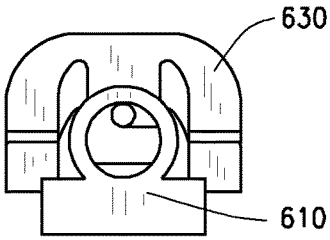
Figure 8A:
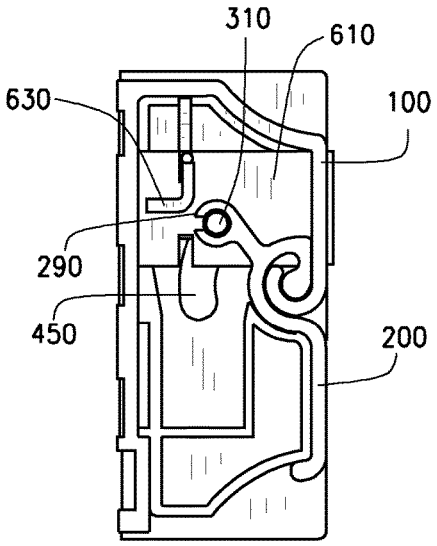
FIGS. 8(A)-8(B) shows the locking assembly engaged to the drawer release.
Figure 8B:
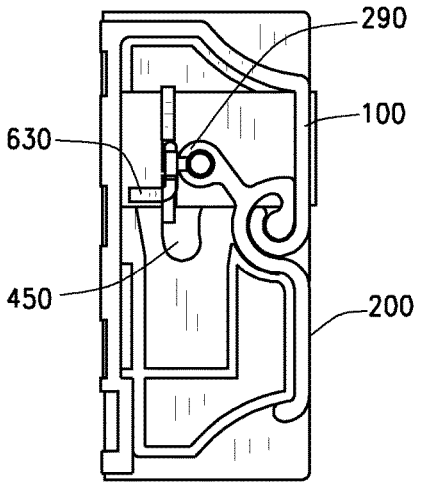

With reference to FIG. 6, the left drawer-slide 530 includes an outer member 531, an intermediate member 532, and an inner member 533. The right drawer-slide 535 includes an outer member 536, an intermediate member 537, and an inner member 538. The outer members 531, 536 and the intermediate members 532, 537 allow the inner members 533, 538 to be pulled completely or nearly completely from the cabinet 590. The left drawer-slide 530 may include one or more left drawer latches 560 while the right drawer-slide 535, may include one or more right drawer latches 570. The drawer release 10 engages a surface 510 of the drawer 500.

A locking assembly for the drawer release 10 will now be shown with reference to FIGS. 7(A)-7(F) and 8(A) and 8(B). The locking assembly includes a lock cylinder 610, a lock plug 620, and a lock cam 630. As the lock plug 620 is unlocked via a key or the like, the lock cam 630 pivots or rotates. The lock cam 630, when in the locked position, physically blocks the rear portion 290 of the handle extrusion 290 from moving. In an unlocked position, the lock cam 630 is moved out of the way of the rear portion 290 during the pulling motion of the handle extrusion 200.

Figure 9A:
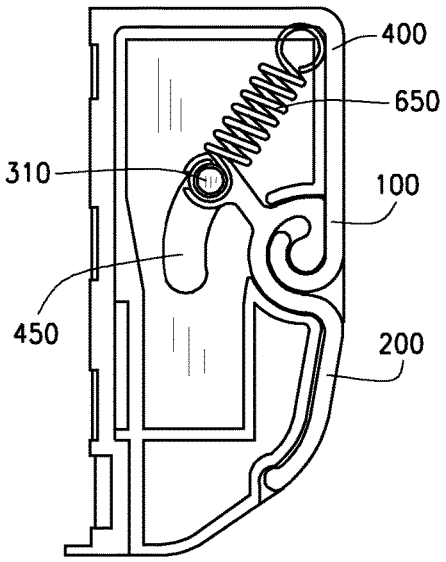
FIGS. 9(A) and 9(B) show alternative biasing members.

A variety of spring biasing members may be used with the drawer release 10. For example, in FIG. 9(A), extension springs 650 are connected to the end caps 400, 405. The extension springs 650 biases the handle extrusion 200 in a closed position. The extension springs 650 may connect directly to the first pin 310 or the second pin 315, respectively. Or, the extension springs 650 may connect to handle extrusion 200 or to the rear portion 290 of the handle extrusion 200.

Figure 9B:
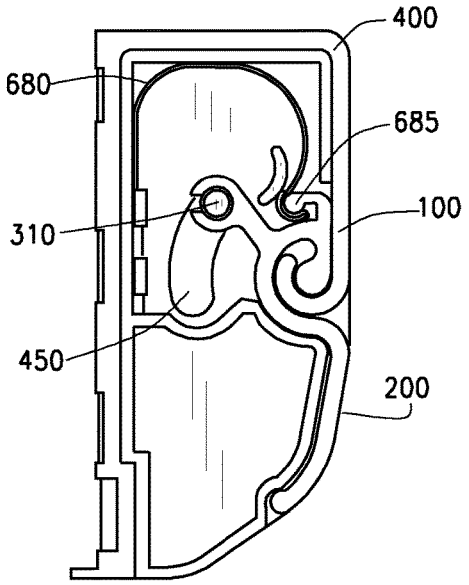
Figure 10A:
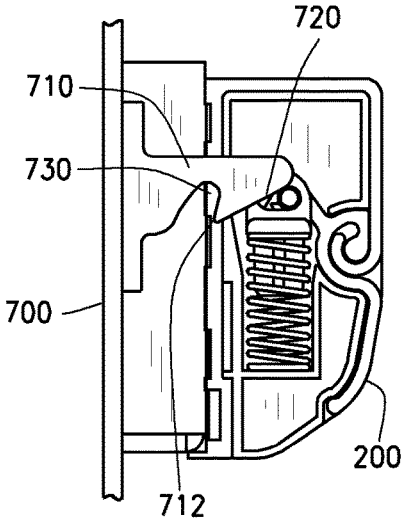
FIGS. 10(A)-10(D) and 11(A)-11(D) show embodiments with a striker.
Figure 10B:
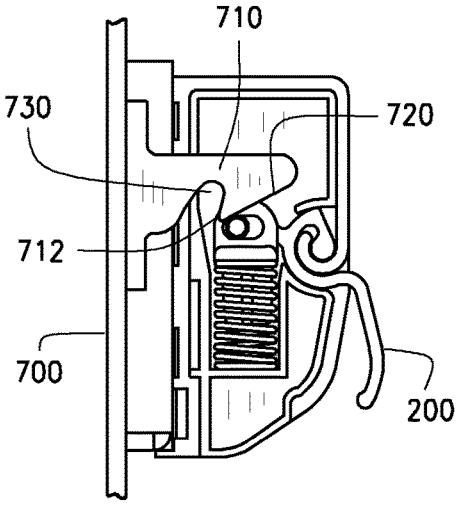
Figure 10C:
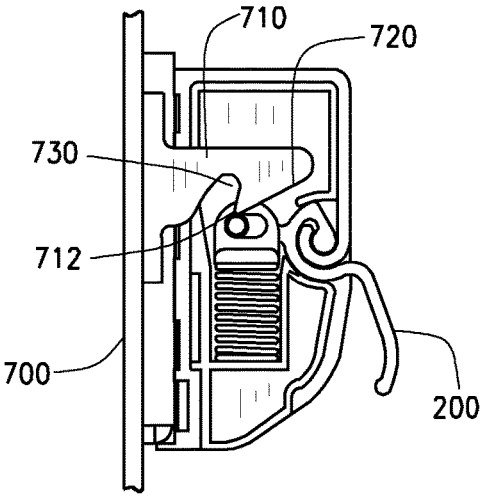
Figure 10D:
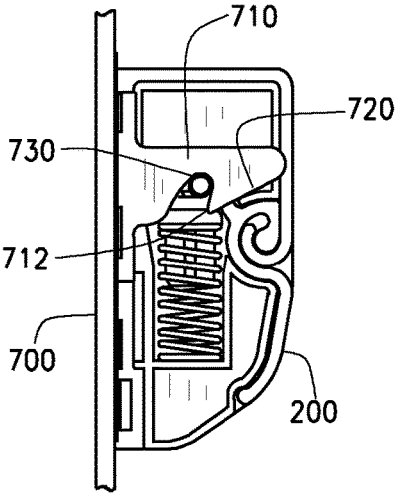
Figure 11A:
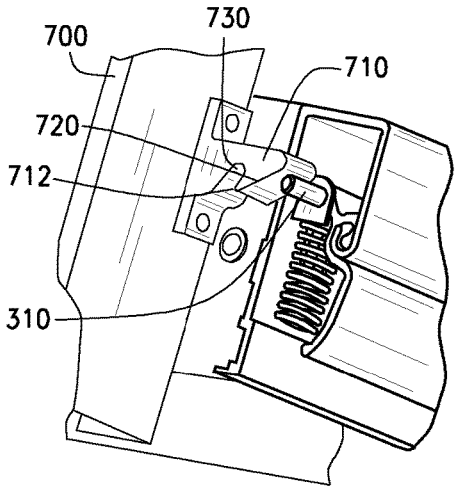
Figure 11B:
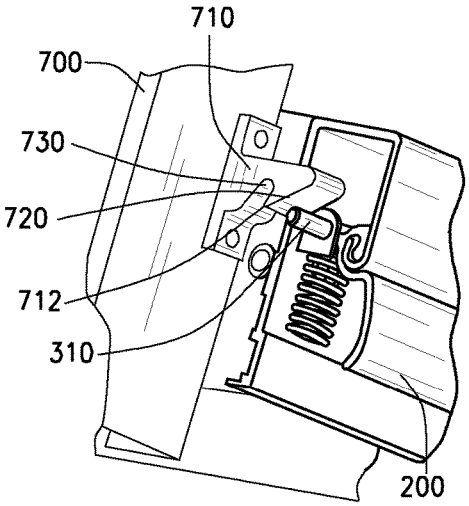
Figure 11C:
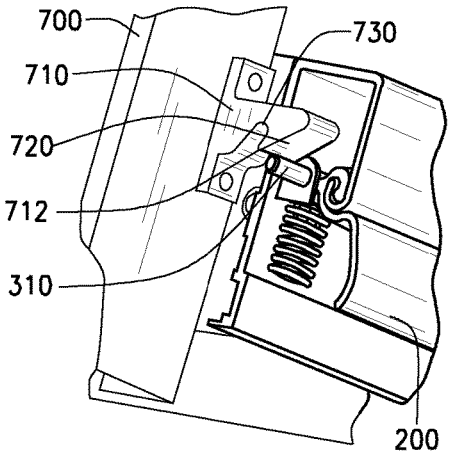
Figure 11D:
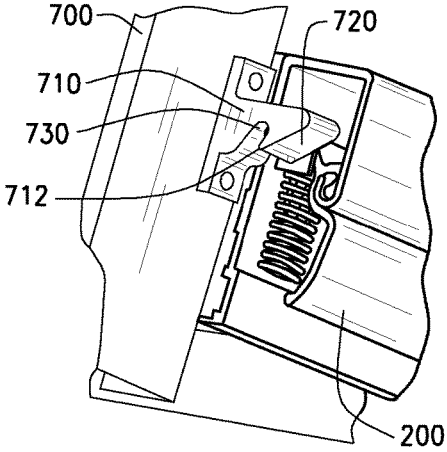

In FIG. 9(B), a leaf spring 680 is shown. The leaf spring 680 connects to a handle extension 685 to bias the handle extrusion 200 in a closed position. When the handle extrusion 200 is pulled, the bias of the leaf spring 680 is overcome to allow the pins 310 and 315 to move downward.

A further aspect is shown in FIGS. 10(A)-10(D) and 11(A)-11(D). In this aspect, the first pin 310 and the second pin 315 engage strikers 710. The strikers 710 are fixed, attached, or integral to a cabinet frame 700 or jamb of the cabinet 590. The pins 310 and 315 engage the striker 710 to lock the drawer 500 closed.

As the drawer 500 is closing, the pins 310 and 315 hit on a sloping contact surface 720 of the strikers 710. As the drawer 500 continues closing, the pins 310 and 315 ride on the sloping contact surface 720, and the slope forces the downward movement of the pins 310 and 315. As the pins 310 and 315 reach and pass an end 712 of the striker 710, the bias of the spring 320 rotates the pin 310 and 315 upward into a retaining area 730 of the striker 710. The drawer 500 is now locked shut. The retaining area 730 may include a hook, slot, recess, opening, groove, etc. in the striker 710 that holds the pins 310 and 315.

When the drawer 500 is opened, the handle extrusion 200 is pulled outward to cause the pins 310 and 315 to rotate downward out of the retaining area 730. As such, the striker 710 provides a drawer 500 that may be slammed shut and securely closed without having to manually actuate a locking assembly other than pressing the drawer 500 closed. The drawer 500 further remains closed until the handle extrusion 200 is pulled to release the pins 310 and 315 from the retaining area 730 of the striker 710.

In other aspects, the drawer release may also be used with push-pull drawer-slides. The drawer release includes a handle or a handle extrusion and a fixed portion or a fixed extrusion that may be used with the push-pull drawer-slides.

Push-pull drawer-slides may lock in the open and in the closed positions. Push-pull drawer-slides typically require the operator to pull an end of the drawer-slide outward in order to unlock or unlatch the drawer-slide, and then the drawer may be fully opened. The end of the drawer-slide is pulled generally parallel to a length of the drawer-slide in order to unlock or unlatch the drawer-slide such that the drawer may then slide open. Further, the push-pull drawer-slides typically require the operator to push the end of the drawer-slide inward in order to unlock or unlatch the drawer-slide such that the drawer may then slide to a closed position. The end of the drawer-slide is pushed generally parallel to a length of the drawer-slide in order to unlock or unlatch the drawer-slide during the closing movement.

The drawer release unlocks one or both latches or locks on one or both push-pull drawer-slides that provide for the sliding engagement of the drawer to the cabinet or the housing. The drawer release allows an operator to pull or push on the handle or the handle extrusion at any point along the handle or the handle extrusion to unlock the drawer. The drawer release provides for the rotating motion from pulling or pushing the handle or the handle extrusion to be translated to a generally horizontal, lateral, or arcuate movement on the ends of the push-pull drawer-slides that unlocks or releases the drawer to be opened or closed.

The drawer release for the push-pull drawer-slide includes the handle portion or the handle extrusion pivotally engaged to the fixed portion or the fixed extrusion. The fixed portion or extrusion is attached, connected, or integral with a front face of the drawer. The handle portion or extrusion includes an engaging member or pin. The drawer release may further include a drawer-slide end cap that is fitted or connected to the end of the push-pull drawer-slide. The drawer-slide end cap receives the engaging member or pin.

The drawer release allows an operator to pull or push on the handle or the handle extrusion at any point along the handle or the handle extrusion to unlock the drawer-slides. The drawer release provides for the rotating motion from pulling or pushing the handle or the handle extrusion to be translated to a generally horizontal, lateral or arcuate movement that moves the ends of the push-pull drawer-slides to unlock or release the drawer-slides in order to open or close the drawer.

Figure 12:
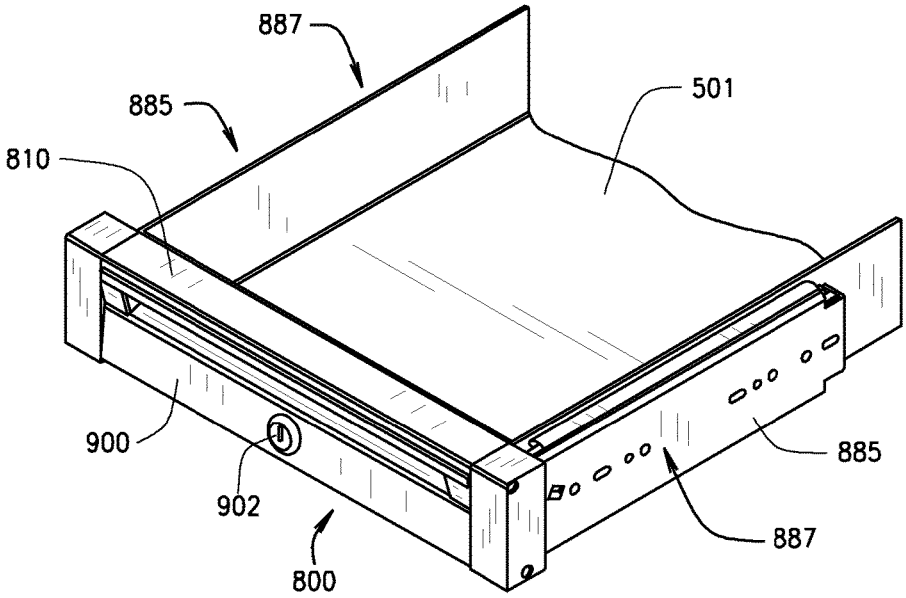
FIG. 12 is a of the drawer release for use with the push-pull drawer-slides on the drawer.
Figure 13:
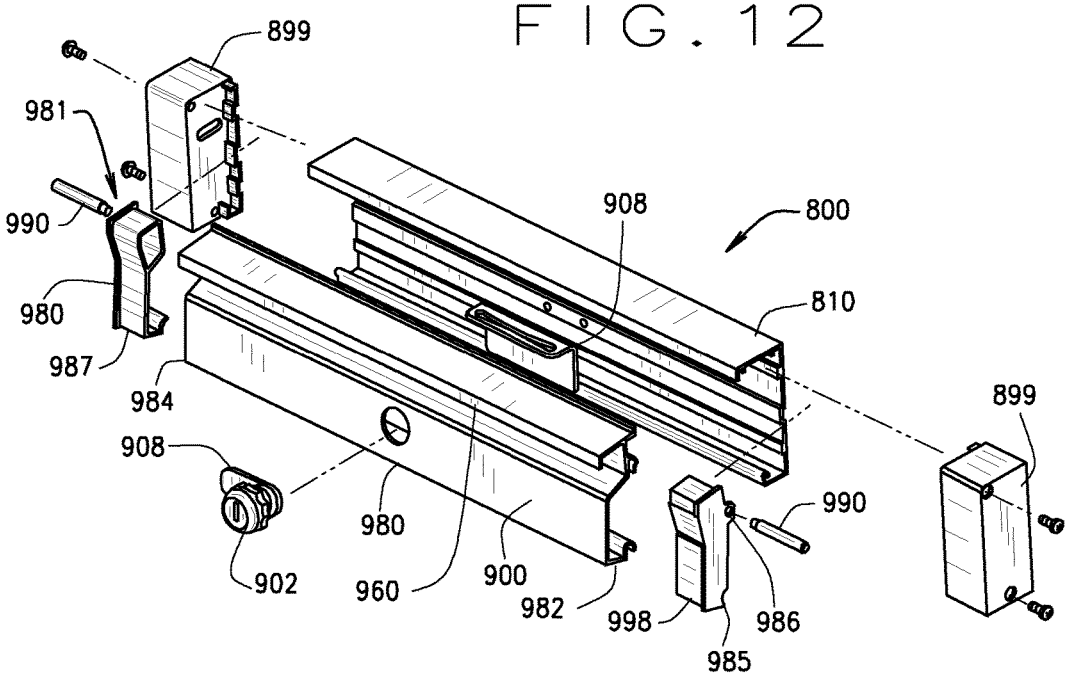
FIG. 13 is an exploded view of the drawer release for use with the push-pull drawer-slides

The drawer release for use with push-pull drawer-slides will now be described with reference to the FIGS. FIG. 12 shows a drawer release 800 installed on a drawer 501. FIG. 13 shows an exploded view of the drawer release 800. The drawer release 800 includes a fixed extrusion 810 hingedly engaged to a handle extrusion 900. The handle extrusion 900 is pushed or pulled to unlock the drawer 501. The fixed extrusion 810 remains in a generally fixed or stationary position relative to the drawer 501, while the handle extrusion 900 pivots or rotates relative to the fixed extrusion 810. The fixed extrusion 810 may include openings to receive screws, rivets, and the like in order to attach the fixed extrusion 810 to the drawer 501.

Figure 16A:
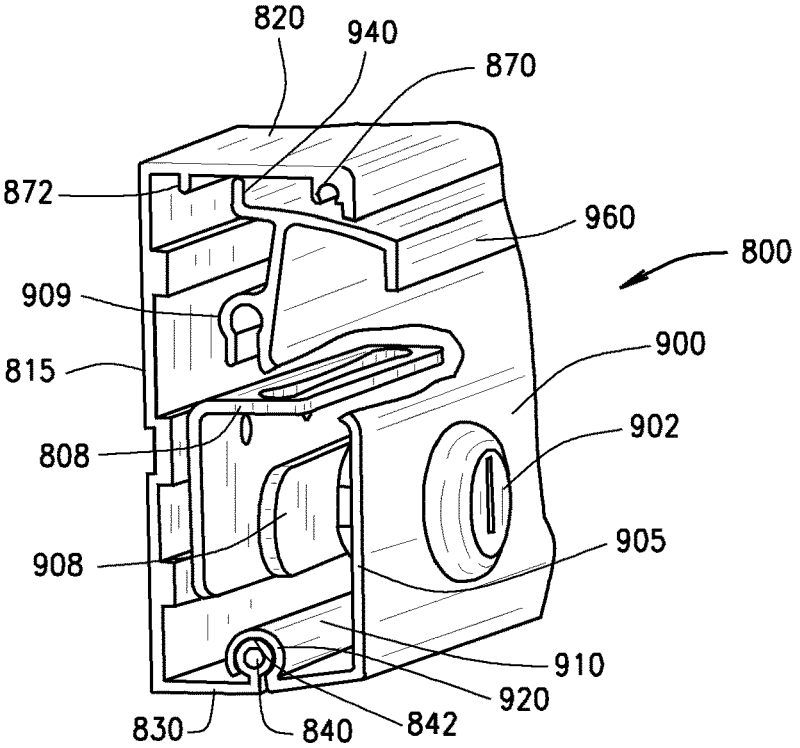
FIGS. 16(A) and 16(B) are end sectionals views of the drawer release showing the locking assembly.
Figure 16B:
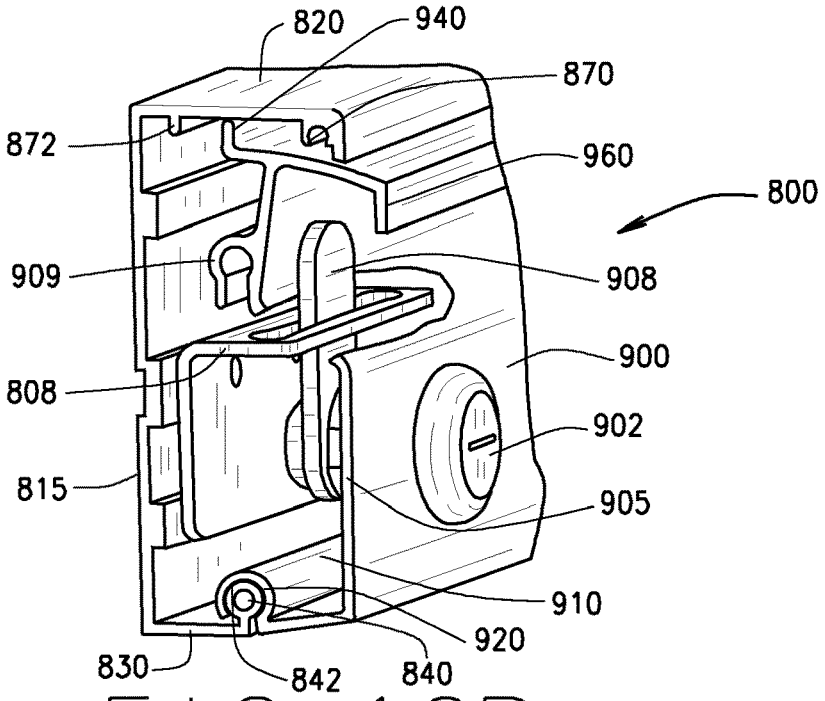

With reference to FIGS. 16(A) and 16(B), the fixed extrusion 810 includes a rear wall 815 that transitions into an upper wall 820. The rear wall 815 also transitions into an lower wall 830 that includes or forms an axis 840. The upper wall 820 may provide limits or stop points for the pushing and pulling of the handle extrusion 900. The fixed extrusion 810 defines an interior that provides space for the pivoting or rotating movement of the handle extrusion 900.

With continued reference to FIGS. 16(A) and 16(B), the axis 840 includes an outer curved surface 842. The axis 840 forms a portion of the hinge or the hingeable connection between the fixed extrusion 810 and the handle extrusion 900. The axis 840 extends most of or all of the width of the drawer 501. The handle extrusion 900 includes a curved channel 910 to receive the axis 840 in a hinging, pivoting, or rotating engagement. The curved channel 910 includes a curved channel inner surface 920. The curved channel 910 extends most of or all of the width of the drawer 501. The curved channel inner surface 920 rotates against the outer curved surface 842 of the axis 840.

The handle extrusion 900 includes a central portion 905. The central portion 905 integrally transitions or attaches to the curved channel 910. Opposite of the curved channel 910, the central portion 905 integrally transitions or attaches to a gripping surface 960 and to a detent 940. The central portion 905 also includes a receiving portion 909 to receive an end of the pin 990 or other engaging member. The receiving portion 909 holds the pin 990 or other engaging member to the handle extrusion 900. The central portion 905 may include two receiving portions 909 on opposite sides of the handle extrusion 900 to position the pins 990 relative to an end 880 of a left drawer-slide 885 and to an end 880 of a right drawer-slide 885.

Figure 14:
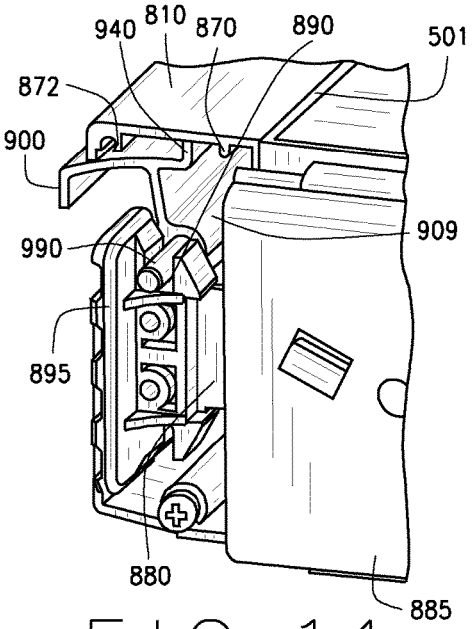
FIG. 14 is a sectional end view of the drawer release with the end cap for the handle removed.

With reference to FIG. 14, the handle extrusion 900 rotates on the axis 840 in a pulling direction until the detent 940 of the handle extrusion 900 contacts a first lower ridge 872 of the fixed extrusion 810. The handle extrusion 900 rotates on the axis 840 in a pushing direction until the detent 940 contacts a second lower ridge 870 of the fixed extrusion 810. The first and second lower ridges 872 and 870 extend or descend from the upper wall 820 of the fixed extrusion 810.

With reference to FIG. 13, the handle extrusion 900 includes a gripping surface 960 that is positioned on or in the handle extrusion 900. The gripping surface 960 may extend an entire width of the handle extrusion 900 between a left portion 984 of the handle extrusion 900 and a right portion 982 of the handle extrusion 900. In other aspects, the grip 960 may just be located at the middle portion 980 of the handle extrusion 900.

A left end cap 980 is fixedly engaged to the left portion 984 of the handle extrusion 900, while a right end cap 985 is fixedly engaged to a right portion 982 of the handle extrusion 900. The left end cap 980 and the right end cap 985 include openings 981 and 986 that allow the pins 990 to pass through the respective end cap 980 and 985. The left end cap 980 and the right end cap 985 have substantially the same construction, except with an opposite orientation to each other. The end caps 980, 985 may be made from metal or plastic and improve the cosmetic appearance of the handle extrusion 900. Caps 899 cover the hinging engagement of the fixed extrusion 810 to the handle extrusion 900.

The left end cap 980 and the right end cap 985 define or include insert portions 987, 998 that fixedly engage to the left portion 984 of the handle extrusion 900 and to the right portion 982 of the of the handle extrusion 900, respectively.

Figure 15A:
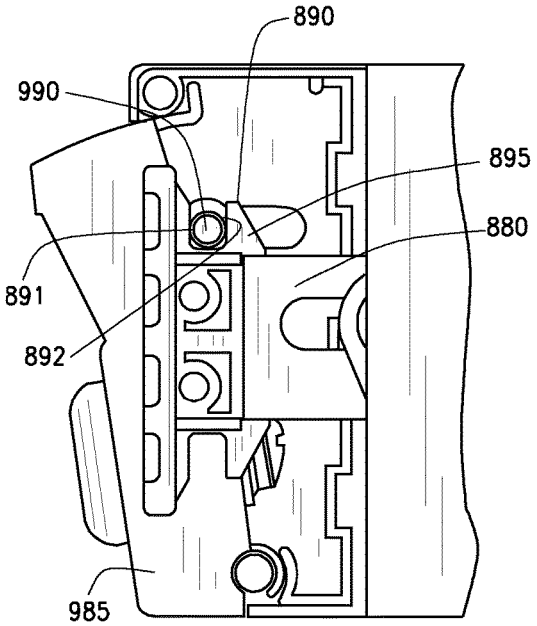
FIG. 15(A) is an end view of the drawer release in a pulling position with the cap removed.
Figure 15B:
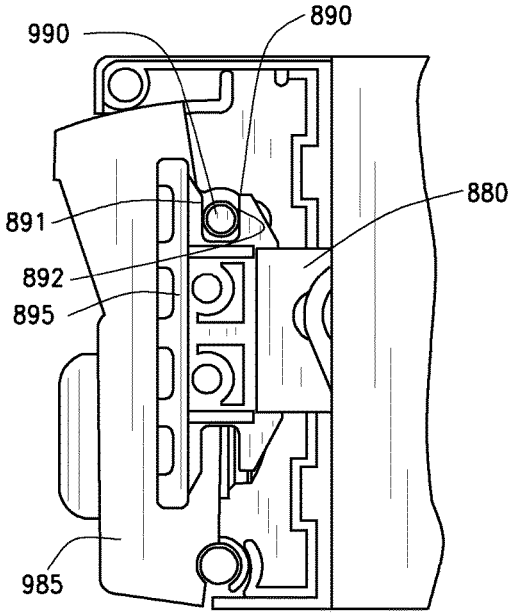
FIG. 15(B) is an end view of the drawer release in a neutral or static position with the cap removed.
Figure 15C:
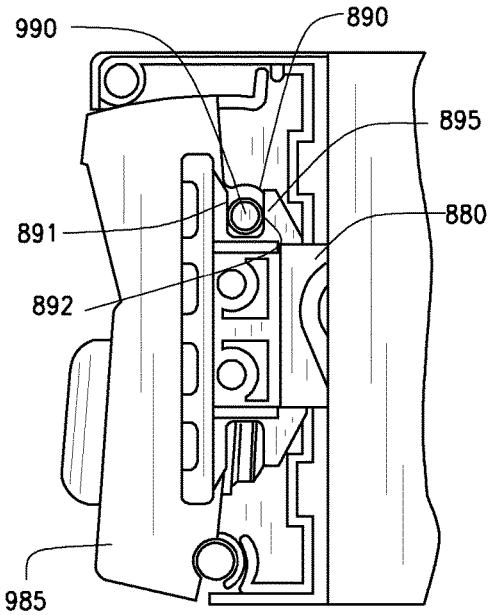
FIG. 15(C) is an end view of the drawer release in a pushing with the cap removed.

With reference to FIGS. 15(A)-(C), during actuation of the drawer release 800, the pins 990 engage the end 880 of the left drawer-slide 885 and the end 880 of the right drawer-slide 885. In other aspects, the drawer release 800 may only contain a single pin 990, on one side of the drawer release 800. Some drawers 501 may only have a locking push-pull drawer-slide on one side of the drawer 501, with a non-locking drawer-slide on the other side of the drawer 501.

As the handle extrusion 900 is pulled or pushed by the operator, the curved channel 910 rotates or pivots about the axis 840. The curved channel inner surface 920 of the curved channel 910 is in a rotating contact with the outer curved surface 842 of the axis 840. In other aspects, the pivoting or rotating connection between the handle extrusion 900 and the fixed extrusion 800 may be reversed or include other conventional or standard hinging or pivoting connections.

When the handle extrusion 900 is pulled outward and/or upward, the pins 990 pull on the ends 880 of the drawer-slide 885 to unlock or unlatch the drawer-slide 885. When the handle extrusion 900 is pushed inward, the pins 990 push on the ends 880 of the drawer-slide 885 to unlock or unlatch the drawer-slide 885. When the handle extrusion 900 is pulled or pushed, the pins 990 are moving generally horizontally or laterally. The pins 990 may move in shallow arc or curve that pushes or pulls the ends 880 of the drawer-slide 885.

The pins 990 are positioned in an opening or recess 890 of a drawer-slide end cap 895 that is fitted or connected to the end of the push-pull drawer-slide 885. When the handle extrusion 900 is pulled, the pins 990 are pulled against a first surface 891 of the drawer-slide end cap 895 to release or unlock a lock or latch of the drawer-slide 885 to allow the drawer 501 slide to open. When the handle extrusion 900 is pushed, the pins 990 are pushed against a second surface 892 of the drawer-slide end cap 895 to release or unlock a lock or latch of the drawer-slide 885 to allow the drawer-slide 885 to close. Pulling or pushing on the handle extrusion 900 simultaneously unlocks both of the drawer-slides 885 positioned on opposite sides of the drawer 501. In other aspects, the drawer-slide end cap 895 may include or define any of a variety of openings of different shapes or other configurations and attachments that engage to the pins 990 to provide for the pushing and pulling on the ends 880 of the drawer-slides 885.

The pins 990 may include other engaging members that push or pull on the ends of the drawer-slide 885 or on the drawer-slide end cap 895. Such engaging members includes rods, connections, ties, etc. that operate to connect the handle extrusion 800 with the ends 880 of the drawer-slide 885 or the drawer-slide end cap 895.

The left drawer-slide 885 may include one or more left drawer latches 887 while the right drawer-slide 885, may include one or more right drawer latches 887.

The handle extrusion 900 rotates on the axis 840 in a pulling direction until the detent 940 of the handle extrusion 900 contacts the first lower ridge 872 of the fixed extrusion 810. The handle extrusion 900 rotates on the axis 940 in a pushing direction until the detent 940 contacts the second lower ridge 870 of the fixed extrusion 810. The amount of rotation provided to the handle extrusion 800 is sufficient to disengage the left drawer latch 887 and the right drawer latch 887. The first lower ridge 870 and the second lower ridge 872 assist in reducing the over-rotation of the handle extrusion 900 and transition the pulling or pushing onto the handle extrusion 900 into a motion or force that pulls the drawer 501 open or pushes the drawer 501 closed.

The drawer release 800 may be used with a variety of commercially available push-pull drawer-slides. For example, the drawer release 800 may be used with drawer-slides commercially available from Knapp & Vogt, such as drawer-slide model 8908.

An optional locking assembly 902 may also lock the handle extrusion 900 to the fixed extrusion 810. The locking assembly 902 may attach or affix to the handle extrusion 900. The locking assembly 902 includes a rotatable tab 908 to engage a lock opening 808 of the fixed extrusion 810. The lock opening 808 may be made from a separate piece of material attached or affixed to the fixed extrusion 810.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A drawer assembly with a release, comprising:

a drawer;

a drawer release comprising a handle portion pivotally engaged to a fixed portion;

the fixed portion attached to or connected to the drawer;

the handle portion and the fixed portion extend an entire width or substantially the entire width of the drawer, wherein the handle portion comprises an axis having an axis surface, and the axis rotates in a curved portion of the fixed portion, and the axis surface rotates against an inner curved surface of the curved portion;

the drawer engaged to a drawer slide to provide a sliding movement to the drawer, the drawer slide having a latch or a lock that prevents the sliding movement of the drawer, the drawer slide having a lever or an actuator integral with the latch or the lock, the lever or the actuator is moveable to release the latch or the lock of the drawer slide and allow the sliding movement of the drawer; and, the drawer release comprising at least one engaging member that extends from the handle portion and the at least one engaging member engages an upper surface of the lever or an upper surface of the actuator of the drawer slide of the drawer to open or release the latch or the lock to allow the sliding movement of the drawer, and wherein a pulling motion applied to the handle portion causes the at least one engaging member to move in a substantially downward direction to press down on the upper surface of the lever or the upper surface of the actuator to open or release the latch or the lock of the drawer slide.

2. The drawer assembly according to claim 1, wherein at least one spring assembly biases the handle portion to a closed position.

3. The drawer assembly according to claim 1, wherein the handle portion is actuated to engage the lever or the actuator by an operator pulling any portion of the handle portion.

4. The drawer assembly according to claim 1, wherein the handle portion is actuated to engage the lever or the actuator positioned on a first side of the drawer and to engage a second lever or another actuator positioned on a second side of the drawer by pulling any portion of the handle portion, wherein the first side of the drawer and second side of the drawer are oppositely disposed.

5. The drawer assembly according to claim 1, wherein the handle portion comprises a curved channel that defines a curved channel inner surface and a curved channel outer surface and the curved channel terminates in an end wall, and the curved portion of the fixed portion defines the inner curved surface and an outer curved surface, wherein the curved channel inner surface and the curved channel outer surface of the handle portion move or slide against the inner curved surface and the outer curved surface of the curved portion of the fixed portion.

6. The drawer assembly according to claim 1, wherein a pivoting motion or a rotating motion of the handle portion is translated by the drawer release to a substantially downward movement of the at least one engaging member.

7. The drawer assembly according to claim 1, wherein the at least one engaging member comprises a pin to engage the lever or the actuator of the drawer slide of the drawer.

8. The drawer assembly according to claim 7, wherein the pin presses down on the lever or the actuator when the handle portion pivots.

9. The drawer assembly according to claim 1, wherein the curved portion of the fixed portion terminates in an end, and the handle portion includes a curved channel that terminates in an end wall, and the handle portion rotates until the end wall contacts the end of the curved portion.

10. The drawer assembly according to claim 1, wherein the at least one engaging member comprises a first engaging member and a second engaging member, wherein the first and second engaging members are on opposite sides of the handle portion.

11. The drawer assembly according to claim 1, wherein the handle portion and the fixed portion are formed by an extrusion process.

12. The drawer assembly according to claim 1, wherein the axis forms an axis of rotation for the handle portion.

13. A cabinet comprising one or more of the drawer assemblies according to claim 1.

14. The drawer assembly according to claim 1, wherein the drawer slide comprises an outer member and an inner member, the inner member is attached to the drawer, the inner member slides relatives to the outer member to provide a sliding movement to the drawer slide.

15. The drawer assembly according to claim 14, wherein the lock or the latch prevents the sliding movement of the drawer slide.

16. The drawer assembly according to claim 14, wherein the lock or the latch prevents the sliding movement of the inner member of the drawer slide relative to the outer member of the drawer slide.

17. The drawer assembly according to claim 14, wherein the lever or the actuator is mounted to an end of the inner member of the drawer slide.

18. The drawer assembly according to claim 1, wherein the lever or an actuator is mounted to an end of the drawer slide.

19. The drawer assembly according to claim 1, wherein the at least one engaging member extends outwardly from the handle portion.

20. The drawer assembly according to claim 1, wherein the at least one engaging member extends outwardly from the handle portion and generally parallel to a front surface of the handle portion.

21. A drawer assembly with a release, comprising:

a handle extrusion comprising a curved channel;

a fixed extrusion comprising a curved portion;

a drawer engaged to first and second drawer slides to provide a sliding movement to the drawer, the first drawer slide having a first lock that prevents the sliding movement of the drawer, the first drawer slide having a first lever integrated to the first lock, the first lever is moveable to release the first lock of the first drawer slide and allow the sliding movement of the drawer, and the second drawer slide having a second lock that prevents the sliding movement of the drawer, the second drawer slide having a second lever integrated to the second lock, the second lever is moveable to release the second lock of the second drawer slide and allow the sliding movement of the drawer;

wherein the curved channel of the handle extrusion pivots about the curved portion of the fixed extrusion; wherein the handle extrusion comprises an axis having an axis surface, and the axis rotates in the curved portion of the fixed extrusion, and the axis surface rotates against an inner curved surface of the curved portion and, the handle extrusion comprising a first pin and a second pin, wherein the first pin and the second pin extend from the handle extrusion, wherein the first pin moves downward and engages the first lever of the first drawer slide to open or release the first lock, wherein the second pin moves downward and engages the second lever of the second drawer slide to open or release the second lock of the drawer.

22. The drawer assembly according to claim 21, wherein the axis forms an axis of rotation for the handle portion, and the axis rotates in the curved portion of the fixed extrusion.

23. The drawer assembly according to claim 21, wherein the curved channel of the handle extrusion defines a curved channel inner surface and a curved channel outer surface, and the curved portion of the fixed extrusion defines the inner curved surface and an outer curved surface, wherein the curved channel inner surface and the curved channel outer surface of the handle extrusion moves or slides against the inner curved surface and the outer curved surface of the curved portion of the fixed extrusion.

24. The drawer assembly according to claim 21, wherein the curved channel and the curved portion extend most of or an entire width of the drawer, and the first lever and the second lever are on opposite sides of the drawer.

25. The drawer assembly according to claim 21, further comprising end caps mounted on ends of the fixed extrusion, the end cap comprising a spring and a spring guide, and the spring guide comprises a base, an opening, and an insert.

26. A method of opening a drawer, comprising:

providing a drawer release comprising a handle portion pivotally engaged to a fixed portion, wherein the handle portion comprises an axis having an axis surface, and the axis rotates in a curved portion of the fixed portion, and the axis surface rotates against an inner curved surface of the curved portion and the handle portion comprising at least one lever engaging member that engages a lever of a drawer slide, the drawer engaged to the drawer slide to provide a sliding movement to the drawer, the drawer slide having a latch or a lock that prevents the sliding movement of the drawer, the lever is integral with the latch or the lock and is moveable to release the latch or the lock of the drawer slide and allow the sliding movement of the drawer;

pulling on the handle portion to pivot the handle portion relative to the fixed portion;

causing the at least one lever engaging member to move generally downward to engage the lever of the drawer slide; and releasing the latch or the lock on the drawer slide to unlatch or unlock the drawer slide to allow the sliding movement of the drawer.

27. The method according to claim 26, further comprising pulling on the handle portion to slide the drawer open, wherein the drawer slides open via the drawer-slide.

28. The method according to claim 26, further comprising pulling on any portion of the handle portion to open the drawer.

29. The method according to claim 26, wherein the at least one lever engaging member comprises at least two lever engaging members and further causing the two lever engaging members to move substantially downward to engage the lever and an additional lever.

30. The method according to claim 26, further comprising causing the at least one lever engaging member to move downward to engage the lever, while simultaneously causing a second lever engaging member to move downward to engage a second lever.

31. A drawer assembly with a release, comprising:

a drawer;

a drawer release comprising a handle portion pivotally engaged to a fixed portion;

the fixed portion attached to or connected to the drawer;

the handle portion and the fixed portion extend an entire width or substantially the entire width of the drawer, wherein the fixed portion includes a curved portion, and the curved portion of the fixed portion terminates in an end, and the handle portion includes a curved channel that terminates in an end wall, and the curved channel rotates around the curved portion until the end wall contacts the end of the curved portion;

the drawer engaged to a drawer slide to provide a sliding movement to the drawer, the drawer slide having a latch or a lock that prevents the sliding movement of the drawer, the drawer slide having a lever or an actuator integral with the latch or the lock, the lever or the actuator is moveable to release the latch or the lock of the drawer slide and allow the sliding movement of the drawer; and, the handle portion comprising at least one engaging member that extends from the handle portion and engages an upper surface of the lever or an upper surface of the actuator of the drawer slide of the drawer to open or release the latch of the lock to allow the sliding movement of the drawer, and wherein a motion applied to the handle portion causes the at least one engaging member to move downward to press against the upper surface of the lever or the upper surface of the actuator to release the latch or the lock of the drawer slide.

32. A drawer assembly with a release, comprising:

a drawer;

a drawer release comprising a handle portion pivotally engaged to a fixed portion;

the fixed portion attached to or connected to the drawer;

the handle portion and the fixed portion extend an entire width or substantially the entire width of the drawer, wherein the handle portion comprises an axis having an axis surface, and the axis rotates in a curved portion of the fixed portion, and the axis surface rotates against an inner curved surface of the curved portion;

the drawer engaged to a drawer slide to provide a sliding movement to the drawer, the drawer slide having a latch or a lock that prevents the sliding movement of the drawer, the drawer slide having a lever or an actuator integral with the latch or the lock, the lever or the actuator is moveable to release the latch or the integral lock of the drawer slide and allow the sliding movement of the drawer; and, the drawer release comprising at least one engaging member in the form of a cylindrical pin that extends from the handle portion and the at least one engaging member and engages an uppermost surface of the lever or an uppermost surface of the actuator of the drawer slide of the drawer to open or release the latch or the lock to allow the sliding movement of the drawer, and wherein a pulling motion applied to the handle portion causes the pin to move in a substantially downward direction to press down on the uppermost surface of the lever or the uppermost surface of the actuator to open or release the latch or the lock of the drawer slide.

33. A drawer assembly with a release, comprising:

a drawer;

a drawer release comprising a handle portion pivotally engaged to a fixed portion;

the fixed portion attached to or connected to a front portion of the drawer;

the handle portion and the fixed portion extend an entire width or substantially the entire width of the front portion of the drawer, wherein the handle portion comprises an axis, and the axis rotates in a curved portion of the fixed portion;

the drawer engaged to a drawer slide, the drawer slide comprising an outer member and an inner member, the inner member attached to the drawer, the inner member slides relative to the outer member to provide a sliding movement to the drawer slide, the drawer slide having an lock that prevents the sliding movement of the drawer slide, the drawer slide having a lever, wherein the lever is moveable to release the lock of the drawer slide and allow the sliding movement of the drawer; and, the drawer release comprising at least one engaging member that extends from the handle portion, and the at least one engaging member engages an upper surface of the lever of the drawer slide of the drawer to open or release the lock to allow the sliding movement of the drawer slide, and wherein a pulling motion applied to the handle portion causes the at least one engaging member to move in a substantially downward direction to press down on the upper surface of the lever to open or release the lock of the drawer slide.

34. A cabinet comprising one or more of the drawer assemblies according to claim 33.

35. A drawer assembly with a release, comprising:

a drawer;

a drawer release comprising a handle extrusion pivotally engaged to a fixed extrusion;

the fixed extrusion attached to or connected to a front portion of the drawer;

the handle extrusion and the fixed extrusion extend an entire width or substantially the entire width of the front portion of the drawer;

the drawer engaged to a drawer slide, the drawer slide comprising an outer member and an inner member, the inner member attached to the drawer, the inner member slides relative to the outer member to provide a sliding movement to the drawer slide, the drawer slide having a lock that prevents the sliding movement of the drawer slide, the drawer slide having a lever rotatably mounted to the drawer slide, wherein the liver is moveable to release the lock of the drawer slide and allow the sliding movement of the drawer; and, the drawer release comprising at least one engaging member that extends from the handle extrusion, and the at least one engaging member engages an upper surface of the lever of the drawer slide of the drawer to open or release the lock to allow the sliding movement of the drawer slide, and wherein a pulling motion applied to the handle extrusion causes the at least one engaging member to move in a substantially downward direction to press down on the upper surface of the lever to open or release the lock of the drawer slide.

36. A cabinet comprising one or more of the drawer assemblies according to claim 35.

* * * * *